United States Patent [19]

Bucholz

[11] 4,399,366

[45] Aug. 16, 1983

[54] SEPARATOR ASSEMBLY FOR USE IN SPENT NUCLEAR FUEL SHIPPING CASK

[75] Inventor: James A. Bucholz, Oak Ridge, Tenn.

[73] Assignee: The United States of America as represented by the U.S. Department of Energy, Washington, D.C.

[21] Appl. No.: 257,030

[22] Filed: Apr. 24, 1981

[51] Int. Cl.[3] ..... G21F 5/00; G21C 3/34

[52] U.S. Cl. ..... 250/507.1; 376/272

[58] Field of Search ..... 250/507.1, 506.1, 522.1; 376/272

[56] References Cited

U.S. PATENT DOCUMENTS 4,004,154 1/1977 Bevilacqua ..... 250/506.1 X 4,034,227 7/1977 Soot ..... 376/272

4,292,528 9/1981 Shaffer et al. ..... 250/506.1

*Primary Examiner*—Alfred E. Smith

*Assistant Examiner*—Jack I. Berman

*Attorney, Agent, or Firm*—Edwin D. Grant; Stephen D. Hamel; Richard G. Besha

[57] ABSTRACT

A separator assembly for use in a spent nuclear fuel shipping cask has a honeycomb-type wall structure defining parallel cavities for holding nuclear fuel assemblies. Tubes formed of an effective neutron-absorbing material are embedded in the wall structure around each of the cavities and provide neutron flux traps when filled with water.

8 Claims, 2 Drawing Figures

SEPARATOR ASSEMBLY FOR USE IN SPENT NUCLEAR FUEL SHIPPING CASK

BACKGROUND OF THE INVENTION

This invention resulted from a contract with the U.S. Department of Energy and relates to a means for safely holding a plurality of nuclear fuel assemblies in a shipping container.

When spent nuclear fuel assemblies are removed from a reactor, they are generally stored at the reactor site for a period of time to permit a reduction in their radioactivitiy and the heat generated thereby. These fuel assemblies are later transferred to a permanent waste isolation site or a reprocessing facility in a shipping cask that must provide (1) neutron and gamma shielding to protect the public from harmful radiation emitted by the spent fuel, (2) a means of dissipating the decay heat generated by the spent fuel, and (3) a means for precluding the possibility of a nuclear criticality accident under the most reactive conditions conceivable. To protect workers from radiation, the spent fuel assemblies are loaded into the shipping cask under water. Because the water present at this time reflects thermalized neutrons back into the fuel, there is a possibility of a nuclear criticality accident occurring in a matter of milliseconds, should the cask inadvertently be loaded with fresh fuel, or fuel with very little accumulated burnup. This represents the most reactive condition conceivable, as prescribed in Section 6 of Reg. Guide 7.9 set forth by the US-NRC.

SUMMARY OF THE INVENTION

It is an object of this invention to provide an improved means for holding a plurality of nuclear fuel assemblies in spaced relation in a shipping cask.

Another object of the invention is to effectively reduce the neutronic coupling between adjacent fuel assemblies in a nuclear fuel shipping cask, and ensure subcriticality during the initial cask loading sequence.

A further object of the invention is to effectively conduct decay heat away from the innermost nuclear fuel assemblies in a shipping cask to cooler regions adjacent the inner shell of the cask.

These objects and various advantages that will become evident hereinafter are attained by a preferred embodiment of the invention comprising a honeycomb-type wall structure placed in a cylindrical housing of a shipping cask and defining a plurality of elongate, parallel cavities each of which is shaped to conformably fit about a nuclear fuel assembly. Embedded in the wall structure around each of the aforesaid cavities are a number of tubes formed of an effective neutron-absorbing material. While nuclear fuel assemblies are being inserted in the cavities of the honeycomb wall structure, the tubes are filled with water and thus constitute a plurality of neutron flux traps situated between adjacent fuel assemblies.

DETAILED DESCRIPTION OF THE PREFERRED EMBODIMENT

Figure 1:
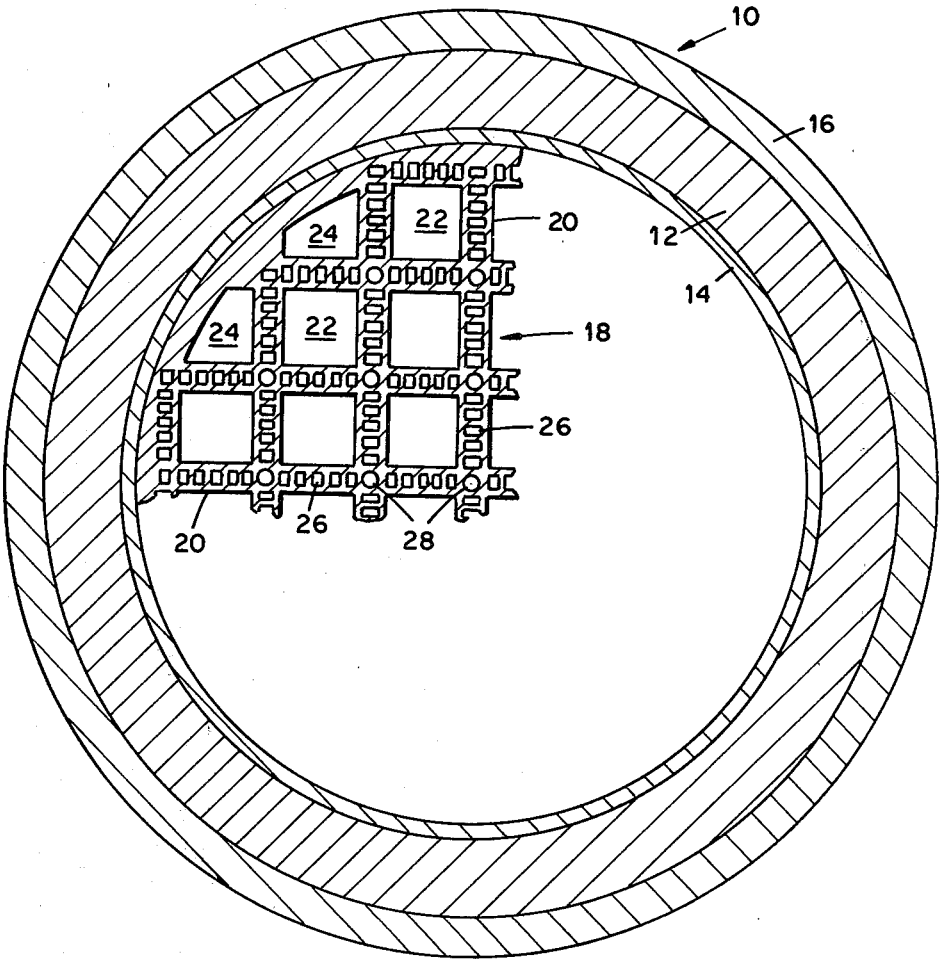
FIG. 1 is a cross-sectional view of components of a typical spent fuel shipping cask employing the preferred separator assembly of the invention, the assembly being only partially illustrated to simplify the drawing.

FIG. 1 illustrates in cross-sectional view, generally designated by reference number 10, a typical cylindrical shipping cask in which the subject invention may be applied, the cask including a tubular gamma shield 12 disposed between inner and outer steel shells designated 14, 16, respectively. Reference number 18 generally designates a metallic insert (also referred to hereinafter as the separator assembly) comprised principally of a wall-forming structure 20 having a plurality of parallel cavities 22 extending longitudinally therethrough, these cavities being arranged in rows that are horizontal in the drawing and columns perpendicular to said rows. Cavities 24 may be formed in the insert near the inner shell wall, and these cavities may be left empty or filled with a material different from that of wall structure 20. The wall structure 20 is formed of a metal that is an effective heat conductor, such as aluminum or copper. Cavities 22 have a square cross-sectional shape, and since the wall structure 20 between the cavities is relatively thin, the wall structure 20 is defined in claims appended hereto as a honeycomb-type structure. Cavities 22 are slightly longer than the nuclear fuel assemblies (not shown) that are held therein when the shipping cask is in use, and the cross section of the cavities is such that they conformably receive these assemblies.

Figure 2:
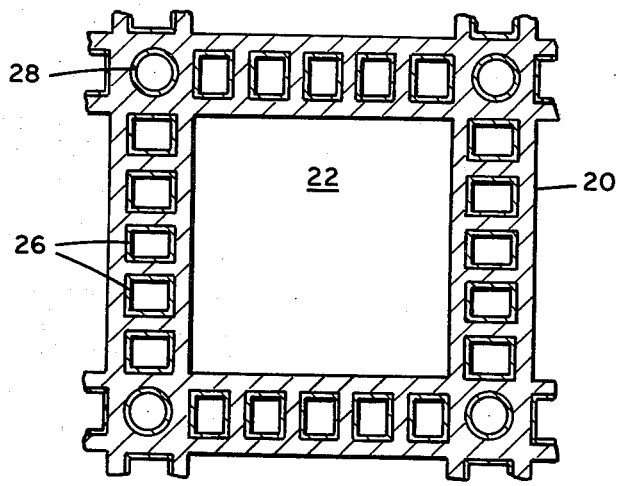
FIG. 2 is a detail view of a portion of the separator assembly illustrated in FIG. 1.

As can best be seen in FIG. 2, a plurality of tubes designated 26, 28, respectively, are disposed around each cavity 22, these tubes being spaced apart and their longitudinal axes being parallel with the longitudinal axes of the cavities. Tubes 26 have a rectangular cross section, whereas tubes 28 at the intersections of the orthogonal wall structure have a circular cross section to increase the mechanical strength of the walls in the corner regions. Each tube 26, 28 is formed of an effective neutron-absorbing material such as the boron-containing stainless steel sold by Carpenter Technology under their designation "Stainless Modified Type 304 with Boron."

To protect workers from radiation, the spent fuel assemblies are loaded into the shipping cask under water. When the cask is placed in the spent fuel pool, tubes 26, 28 are open at both ends of wall structure 20 to allow water to fill the tubes. The water-filled tubes then constitute neutron flux traps, since epithermal neutrons released by the nuclear fuel pass through the walls of the tubes into the water therein, which serves to slow down the neutrons to the point that most are absorbed by the neutron-absorbing material of the tubes and never return to the fissile fuel. Also important is the fact that the wall-forming structure 20 displaces much of the extraneous water between fuel assemblies. Thus, those neutrons which pass between adjacent assemblies without passing through the neutron-absorbing tubes do not encounter any excess water in which to thermalize and become more reactive.

After the cavities 22 have been filled with fuel assemblies, the cask is removed from the spent fuel pool and drained of excess water under a slight vacuum. This precaution is taken so as to preclude the generation of steam and the buildup of internal pressures under postulated accident conditions involving a half-hour fire. Removal of this water greatly reduces the posibility of spreading radioactive contaminants to the environment should the cask develop a leak as a result of a severe impact against any unyielding surface prior to the postulated half-hour fire. One of the advantages of the described wall structure 20 is that decay heat released by the radioactive fuel assemblies held therein is readily conducted through the wall structure network to the outer portion of the cask, thereby minimizing the temperature of the innermost fuel assemblies. If the decay heat load imposed by the spent fuel is quite high and if the integrity of a closed-looped forced-circulation cooling system can be ensured, some or all of the tubes 26, 28 may be made an integral part of said system, thus providing additional cooling for the wall structure 20.

Modifications of the above-described nuclear fuel shipping cask can obviously be made within the scope of the invention. For example: cavities 22 in adjacent rows may be staggered with respect to each other instead of being arranged in rows and columns as illustrated; the number and arrangement of such cavities can be varied; the cross-sectional shape of the neutron-absorbing tubes 26, 28 can be varied; and the separator assembly may be adapted for use in non-circular shipping casks. Lastly, the separator assembly 18 having a honeycomb-type wall structure 20 may be fabricated as a monolithic structure by casting a suitable metal around the neutron-absorbing tubes, or it may be fabricated in sections and assembled by suitable means, such as welding.

What is claimed is:

1. A system for use in handling nuclear fuel, comprising;

a honeycomb-type wall structure defining a plurality of elongate, parallel cavities each shaped to receive a nuclear fuel assembly; and a plurality of tubes extending through said wall structure and disposed around each of said cavities therein, said tubes being formed of an effective neutron-absorbing material and being filled with a moderator fluid so as to constitute neutron flux traps.

2. The separator assembly of claim 1 wherein said tubes are formed of a material containing boron.

3. The separator assembly of claim 2 wherein said wall structure is formed of an effective heat-conducting material.

4. The separator assembly of claim 2 wherein said wall structure is formed of aluminum.

5. The separator assembly of claim 2 wherein said wall structure is formed of copper.

6. The separator assembly of claim 1 wherein at least some of said tubes have a rectangular cross section and some of said tubes have a circular cross section.

7. The separator assembly of claim 1 wherein said cavities are disposed in mutually perpendicular rows and columns, said rows and columns being either aligned or staggered with respect to each other.

8. The separator assembly of claim 1 wherein said tubes are spaced apart from one another.

* * * * *